US006072514A

United States Patent [19]

Shudo et al.

[11] Patent Number: 6,072,514

[45] Date of Patent: Jun. 6, 2000

[54] PRINT HEAD COMPRISING A PLURALITY OF DRIVER ICS HAVING ADDITIONAL DATA OUTPUT PINS

[75] Inventors: Junichi Shudo; Mitsuhiko Fukuda; Masato Sakai, all of Kyoto, Japan

[73] Assignee: Rohm Co., Ltd., Japan

[21] Appl. No.: 08/160,275

[22] Filed: Dec. 2, 1993

[30] Foreign Application Priority Data

Mar. 31, 1993 [JP] Japan ..... 5-073563

[51] Int. Cl.[7] ..... B41J 2/355

[52] U.S. Cl. ..... 347/211

[58] Field of Search ..... 347/9, 12, 13, 347/211, 180, 181, 182, 237, 132, 145; 377/72, 76, 75

[56] References Cited

U.S. PATENT DOCUMENTS 3,178,586 4/1965 Rosenfeld ..... 377/75
3,609,391 9/1971 Hatano et al. ..... 377/75
3,691,472 9/1972 Bohman ..... 377/75
5,371,525 12/1994 Murano ..... 347/237

OTHER PUBLICATIONS

"Barrel Shifter", IBM Technical Discl.. Bulletin, vol. 28, No. 7, Pop 2769–2772, Dec. 1985.

*Primary Examiner*—N. Le
*Attorney, Agent, or Firm*—Fish & Richardson P.C.

[57] ABSTRACT

A print head for which the number of bits can be set to a predetermined value when a plurality of driver ICs are connected. Data input through a data input pin is passed through an internal shift register and output through a data output pin. The data output pin of one driver IC is connected to a data input pin of another, thereby providing any desired number of shift register bits. Each driver IC has additional data output pins and can output intermediate data through one of the data output pins. Therefore, the additional data output pins can be used to change the number of significant bits of the driver IC. Consequently, when the driver ICs are connected to each other, the number of shift register bits can be adjusted.

6 Claims, 2 Drawing Sheets

PRINT HEAD COMPRISING A PLURALITY OF DRIVER ICS HAVING ADDITIONAL DATA OUTPUT PINS

BACKGROUND OF THE INVENTION

1. Field of the Invention

This invention relates to a print head of a printer used with a facsimile machine, wordprocessor, or the like.

2. Description of the Related Art

Hitherto, thermal printers for printing by heating the heating elements for transferring ink of an ink ribbon to paper or developing color on thermosensible paper have been known. Particularly, the thermal printers can be easily miniaturized and are used with various machines such as facsimile machines and wordprocessors.

The thermal printer has heating elements for one line and heats them in response to print data for one line of printing. Thus, the thermal printer has a shift register which stores 1-line of print data which is set in the register. The shift register is formed with driver ICs for every 32 or 64 bits. The driver ICs are connected in series conforming to the number of dots of a thermal print head to enable printing on one line. That is, each driver IC has one data input pin and one data output pin and the data output pin of one driver IC is connected to the data input pin of another driver IC, thereby increasing the number of bits of the shift register.

For example, a thermal head for a facsimile machine to print on paper of A4 size provides 1728 dots if the dot density is eight dots/mm, and comprises 27 64-bit driver ICs connected in series; to print on paper of B4 size, the thermal head provides 2048 dots and comprises 32 64-bit driver ICs connected in series.

Although a plurality of IC drivers are thus connected in series to increase the number of bits, preferably the number of bits of one driver IC should be increased for reducing costs. In recent years, the integration degree of IC has advanced with the progress of the IC manufacturing technologies, and it is easy to increase the number of bits of one driver IC; for example, it is possible to increase the number of bits to 96 or 128.

However, if the number of bits of one driver IC is increased, flexibility in combination will be less, and the number of dots of a thermal head may not match the total number of bits of driver ICs. For example, to use 96-bit driver ICs to provide 2048 dots, $$96 \times 21 = 2016$$

$$96 \times 22 = 2112$$

thus, if 21 driver ICs are connected in series, it is 32 bits short; if 22 driver ICs are connected in series, there are 64 bits too many.

Then, 22 driver ICs are connected in series and the last 64-bit register portion is not used. However, in the configuration, output of the output pin of the last driver IC contains data in the unused register portion, and does not correspond to print data. Output data of driver ICs may be noted depending on print head application, in which case the print head is not applicable.

SUMMARY OF THE INVENTION

Accordingly, it is an object of the invention to provide a print head capable of efficiently removing adverse effects produced by unused register bits.

To this end, according to one embodiment of the invention, there is provided a print head having a plurality of driver ICs, each driver IC including data input means for inputting print data for each dot in series, a shift register being connected to the data input means for transferring input print data in sequence, output means being connected to the shift register for outputting print data stored in the shift register to print means in parallel, data output means for outputting print data stored at the last bit of the shift register, and additional data output means for outputting print data stored at an intermediate bit of the register, wherein the driver ICs are cascaded by using the data output means or the additional data output means.

The additional data output means enables the number of bits of the driver IC to be changed. For example, if a 96-bit shift register is contained and the additional data output means is provided at the 32nd and 64th bits, the number of bits of the driver IC can be set to 96, 64, or 32 for use. For example, to cover 2048 dots used with a B4 facsimile machine, 20 96-dot driver ICs and two 64-dot driver ICs are provided, whereby a 2048-bit shift register can be formed.

Therefore, 2048-bit print data can be printed by transferring data for one line at a time. Data can also be output from the last driver IC.

DESCRIPTION OF THE PREFERRED EMBODIMENT

Figure 1:
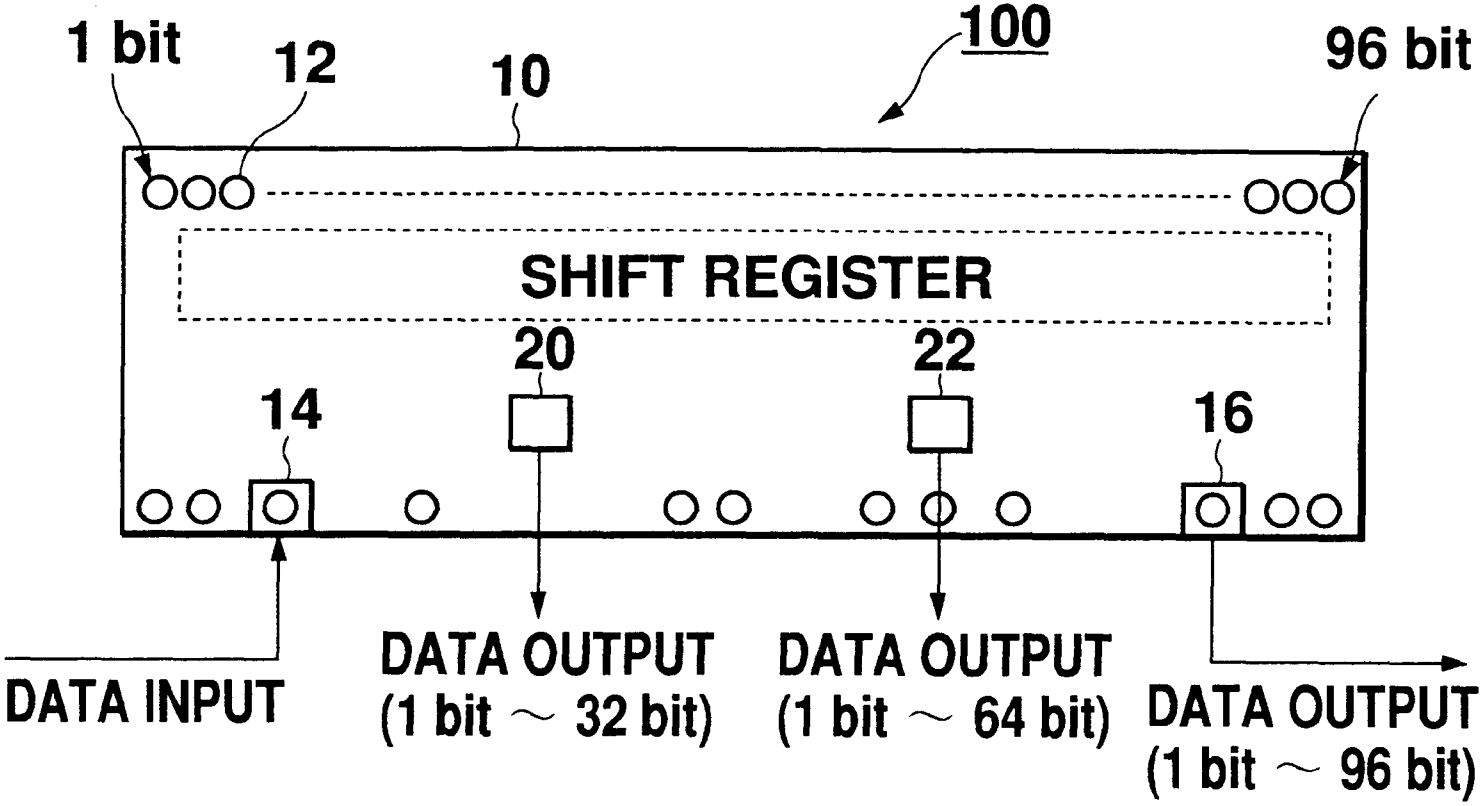
FIG. 1 is a drawing showing a schematic configuration of a driver IC of a print head according to one embodiment of the invention.

Referring now to the accompanying drawings, there is shown a preferred embodiment of the invention. FIG. 1 is a drawing showing a schematic configuration of a driver IC according to one embodiment of the invention. A plurality of output pins 12 are disposed on the upper portion of a main body 10. The driver IC 100 in the embodiment is 96 bits and is provided with 96 output pins. A data input pin 14 and a data output pin 16 are disposed in the lower left and right end portions of the main body 10 respectively. Various pins such as a clock input pin for the driver IC 100 to operate are disposed in the lower portion of the main body 10.

A 96-bit shift register is contained in the main body 10; data input through the data input pin 14 is shifted in sequence in response to a clock. Thus, a plurality of the driver ICs 100 are provided and the data output pin 16 of one driver IC 100 is connected to the data input pin 14 of another driver IC 100, thereby forming a shift register of a predetermined number of bits.

The driver IC 100 in the embodiment has additional data output pins 20 and 22. In the example, the data output pin 20 is connected to the output end of the 32nd register bit and the data output pin 22 to the output end of the 64th register bit. Then, the data output pin 20 or 22 can be used to set the number of significant bits of the driver IC 100 to 32 or 64.

For application to a 2048-dot thermal printer, the data output pin 16 is used at 21 driver ICs 100 and the data output pin 20 is used at one driver IC 100, thereby setting the number of shift register bits to 2048. The driver IC where the data output pin 20 is used can be located at any desired position. In this case, outputs of the 33rd to 96th bits of the shift register of the driver IC whose data output pin 20 is used are not connected to heating elements.

Two driver ICs 100 whose data output pin 22 is used may be disposed with the data output pin 16 used at the remaining 20 driver ICs 100. If the two driver ICs 100 whose data output pin 22 is used are located separately on the left and right sides, the total number of bits of each of the first and second halves of the driver IC group becomes 1024. Then, the configuration can also be applied to a system in which data on one line is divided into two parts for inputting 1024 bits at a time.

Figure 2:
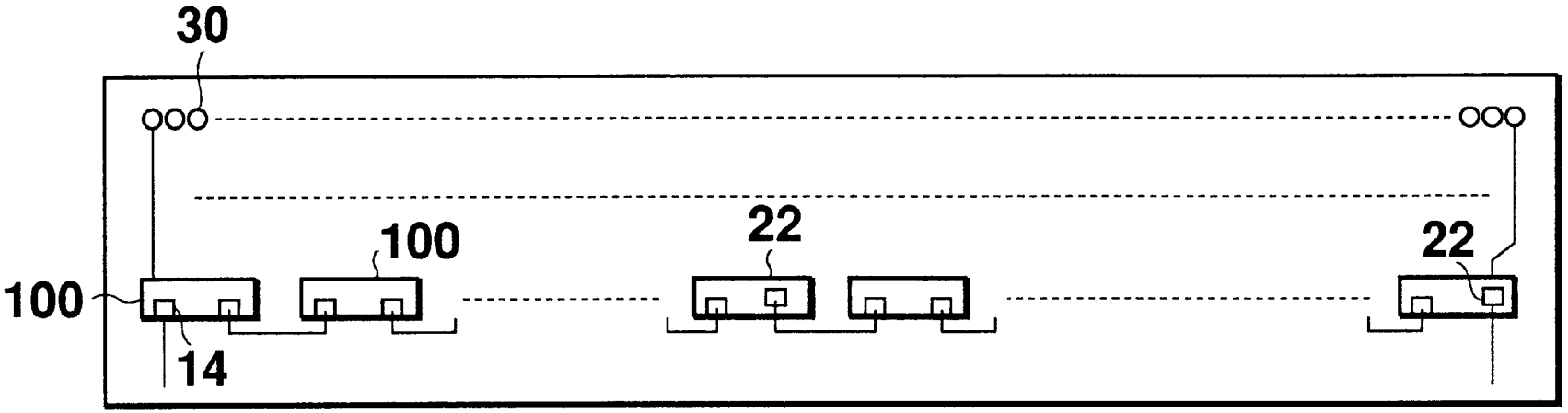
FIG. 2 is a drawing showing how the driver ICs in FIG. 1 are located.

If unused bits are divided thus, the number of unused bits at one driver IC 100 decreases. Connection wiring of output pins 12 and heating elements 30 becomes natural and easy to make, as shown in FIG. 2.

In the example, the number of bits of one driver IC 100 is 96 and additional data output pins 20 and 22 are provided for the 32nd and 64th bits respectively, but any number of bits can be assigned to the driver IC 100 and one or more than three additional data output pins may be provided. Although the thermal printer head is discussed in the embodiment, the invention can also be applied to driver ICs for an LED head.

As described above, with the printer head according to the embodiment, the number of bits of one driver IC can be changed, thus the driver ICs can be connected to each other to form a shift register of a predetermined number of bits for data transfer conforming to the number of print data items.

What is claimed is:

1. A print head having a plurality of driver ICs, each driver IC including:

a main body;

a data input terminal formed on said main body, connected to input print data for each dot in a sequence;

a shift register formed on said main body to have at least a first cell, an intermediate cell and a last cell, said first cell being connected to said data input terminal, said print data being shifted to pass through said first cell, said intermediate cell and said last cell in sequence;

output pins formed on said main body and connected to said shift register, for outputting said print data stored in said shift register to print means in parallel;

a data output terminal, formed on said main body and connected to said last cell for outputting said print data from the last cell;

an additional data output terminal formed on said main body to be connected to the intermediate cell for outputting said print data from the intermediate cell; and a connection wiring, formed from one of said data output terminal or said additional data output terminal to communicate said print data.

2. The print head as claimed in claim 1 wherein each of said plurality of driver ICs is provided with two or more of said additional data output terminals.

3. A driver IC comprising:

a base;

a plurality of output pins provided on said base;

a shift register formed on said base to have a first, an intermediate and a last cell connected to corresponding ones of said output pins, said shift register operating to provide a set of parallel binary data through said output pins;

a data input terminal formed on said base to be connected to said first cell and capable of receiving said parallel binary data in the form of serial data;

a data output terminal formed on said base to be connected to said last cell and capable of outputting said serial data; and an additional data output terminal formed on said base to be connected to said intermediate cell and capable of outputting said serial data.

4. A print head comprising a plurality of driver ICs, each driver IC including:

a base;

a plurality of output pins provided on said base;

a shift register formed on said base to have a first, an intermediate and a last cell connected to corresponding said output pins, said shift register capable of providing a set of parallel binary data through said output pins;

a data input terminal formed on said base to be connected to said first cell and capable of receiving said parallel binary data in the form of serial data;

a data output terminal formed on said base to be connected to said last cell and capable of outputting said serial data; and an additional data output terminal formed on said base to be connected to said intermediate cell and capable of outputting said serial data, wherein a connection wiring is formed to extend from either one of said data output terminal or additional data output terminal.

5. A print head as defined in claim 4, wherein said connection wiring is connected to the data input terminal of an adjacent driver IC.

6. A print head according to claim 4, wherein only cells between the first and intermediate cells are connected to corresponding dot elements which is capable of printing dots.

* * * * *